US007699214B2

(12) United States Patent
Mestre et al.

(10) Patent No.: US 7,699,214 B2
(45) Date of Patent: Apr. 20, 2010

(54) CARTON WITH RECLOSEABLE LID

(75) Inventors: Ignacio Mestre, Barcelona (ES); Emili Requena, Igualada (ES); Enric Sanchez, Igualada (ES)

(73) Assignee: Graphic Packaging International, Inc., Marietta, GA (US)

( * ) Notice: Subject to any disclaimer, the term of this patent is extended or adjusted under 35 U.S.C. 154(b) by 489 days.

(21) Appl. No.: 11/602,646

(22) Filed: Nov. 21, 2006

(65) Prior Publication Data

US 2007/0119914 A1 May 31, 2007

(30) Foreign Application Priority Data

Nov. 29, 2005 (ES) ..... 200502945/9

(51) Int. Cl.

| | |
|---|---|
| ***B65D 3/00*** | (2006.01) |
| ***B65D 5/56*** | (2006.01) |
| ***B65D 17/00*** | (2006.01) |
| ***B65D 71/00*** | (2006.01) |
| ***B65D 73/00*** | (2006.01) |
| ***B65D 25/14*** | (2006.01) |
| ***B65D 35/14*** | (2006.01) |

(52) U.S. Cl. ..... 229/232; 229/117.34; 229/117.35; 229/229; 206/233; 206/494; 220/495.1; 220/495.01

(58) Field of Classification Search ..... 229/117.34, 229/117.35, 232, 229; 206/233, 494, 812; 220/910, 495.1, 495.01

See application file for complete search history.

(56) References Cited

U.S. PATENT DOCUMENTS

| | | | | |
|---|---|---|---|---|
| 1,772,625 | A | | 8/1930 | Caulfield |
| 2,139,021 | A | | 12/1938 | Johnson |
| 2,192,722 | A | | 3/1940 | Vogt |
| 2,345,486 | A | | 3/1944 | Nathan |
| 2,355,665 | A | | 8/1944 | Mabee |
| 2,396,310 | A | | 3/1946 | Gibson |
| 2,437,926 | A | * | 3/1948 | Ball et al. ..... 229/125.09 |
| 2,973,086 | A | * | 2/1961 | Thompson ..... 206/767 |
| 3,021,002 | A | * | 2/1962 | Guyer ..... 206/494 |
| 3,033,362 | A | * | 5/1962 | Marcalus ..... 206/494 |
| 3,355,089 | A | | 11/1967 | Champlin |
| 3,363,822 | A | | 1/1968 | Maulini et al. |
| 3,426,955 | A | | 2/1969 | Olson |
| 3,486,682 | A | | 12/1969 | Whipperman |
| 3,669,345 | A | | 6/1972 | Cote |

(Continued)

FOREIGN PATENT DOCUMENTS

DE 29 23 455 A1 12/1980

(Continued)

OTHER PUBLICATIONS

Search Report—ES 200502945/9.

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton includes a pivoting recloseable lid that is easy to open and recluse. The recloseable lid includes a breachable closure aperture section that can be adapted to receive a portion of a bag or other flexible container accommodated within the carton. When the lid is opened, the contents of the flexible container can be dispensed.

36 Claims, 5 Drawing Sheets

U.S. PATENT DOCUMENTS

| | | | | | |
|---|---|---|---|---|---|
| 3,680,766 | A | | 8/1972 | Collura et al. | |
| 3,690,544 | A | | 9/1972 | Meyers | |
| 3,768,719 | A | | 10/1973 | Johnson | |
| 4,262,816 | A | * | 4/1981 | Margulies | 221/46 |
| 4,344,537 | A | | 8/1982 | Austin | |
| 4,484,683 | A | | 11/1984 | Werner, Jr. | |
| 4,508,218 | A | | 4/1985 | Focke et al. | |
| 4,512,476 | A | * | 4/1985 | Herrington, Jr. | 206/554 |
| 4,558,785 | A | | 12/1985 | Gordon | |
| 4,572,423 | A | * | 2/1986 | Spencer | 206/562 |
| 4,584,202 | A | | 4/1986 | Roccaforte | |
| 4,645,108 | A | | 2/1987 | Gavin et al. | |
| 4,676,394 | A | | 6/1987 | Hiersteiner | |
| 4,746,019 | A | * | 5/1988 | Prater | 229/207 |
| 4,863,052 | A | * | 9/1989 | Lambert | 229/117.3 |
| 4,905,898 | A | | 3/1990 | Wade | |
| 5,265,799 | A | | 11/1993 | Stone | |
| 5,347,865 | A | | 9/1994 | Mulry et al. | |
| 5,356,022 | A | * | 10/1994 | Tipps | 229/117.3 |
| 5,363,981 | A | | 11/1994 | Giblin et al. | |
| 5,427,267 | A | | 6/1995 | Willman | |
| 5,632,402 | A | | 5/1997 | Walsh et al. | |
| 5,632,404 | A | | 5/1997 | Walsh | |
| 5,746,871 | A | | 5/1998 | Walsh | |
| 5,783,030 | A | | 7/1998 | Walsh | |
| 5,794,811 | A | | 8/1998 | Walsh | |
| 5,794,812 | A | | 8/1998 | Walsh | |
| 5,857,614 | A | | 1/1999 | Walsh | |
| 5,918,799 | A | | 7/1999 | Walsh | |
| 5,960,555 | A | * | 10/1999 | Deaton et al. | 34/58 |
| 5,996,797 | A | * | 12/1999 | Flaig | 206/494 |
| 6,102,277 | A | | 8/2000 | Krapohl, Sr. | |
| 6,352,096 | B1 | | 3/2002 | Walsh | |
| 6,364,202 | B1 | | 4/2002 | Zelley | |
| 6,568,586 | B1 | * | 5/2003 | VanEsley et al. | 229/120.18 |
| 6,761,269 | B2 | * | 7/2004 | Hamming | 206/777 |
| 6,854,639 | B2 | | 2/2005 | Walsh | |
| 7,025,504 | B2 | | 4/2006 | Olin | |
| 7,407,087 | B2 | | 8/2008 | DeBusk et al. | |
| 2001/0048022 | A1 | | 12/2001 | Zoeckler | |
| 2002/0036153 | A1 | * | 3/2002 | Yang | 206/494 |
| 2002/0055429 | A1 | | 5/2002 | Walsh | |
| 2003/0144121 | A1 | | 7/2003 | Walsh et al. | |
| 2004/0007614 | A1 | * | 1/2004 | Saulas | 229/232 |
| 2004/0226989 | A1 | | 11/2004 | Cook et al. | |
| 2005/0109827 | A1 | * | 5/2005 | Martin | 229/232 |
| 2005/0187087 | A1 | | 8/2005 | Walsh | |
| 2006/0049067 | A1 | | 3/2006 | McDonald | |
| 2006/0243783 | A1 | | 11/2006 | Spivey, Sr. et al. | |
| 2006/0255105 | A1 | | 11/2006 | Sweet | |
| 2006/0255107 | A1 | | 11/2006 | Wright | |
| 2006/0266810 | A1 | | 11/2006 | Foushee | |

FOREIGN PATENT DOCUMENTS

| | | | |
|---|---|---|---|
| DE | 81 10 323.9 | | 9/1981 |
| DE | 87 08 078.8 | | 10/1987 |
| DE | 94 13 813 | U1 | 10/1994 |
| EP | 1 457 425 | A1 | 9/2004 |
| FR | 2 699 150 | | 6/1994 |
| FR | 2 755 670 | | 5/1998 |
| GB | 104445 | | 3/1917 |
| GB | 1 242 356 | | 8/1971 |
| GB | 1 489 963 | | 10/1977 |
| GB | 1 584 066 | | 2/1981 |
| GB | 2 363 372 | A | 12/2001 |
| WO | WO 95/28325 | | 10/1995 |
| WO | WO 2006/133401 | A2 | 12/2006 |

* cited by examiner

CARTON WITH RECLOSEABLE LID

BACKGROUND

Conventional dispensing cartons are known. Such cartons often include a bag or other flexible container accommodated within the interior of the carton. The bag may be used to store foodstuffs or other dispensable products. Conventional cartons, however, may be difficult to open, may not close reliably, and may not adequately seal a bag or other flexible container contained within the carton.

SUMMARY

According to a first embodiment of the invention, a carton comprises at least one front panel; at least one back panel; at least one first side panel; at least one second side panel; a top panel; and a closure flap. A recloseable lid is defined in the top panel and in the closure flap, the recloseable lid including a lid panel with a closure aperture section formed therein.

According to the first aspect of the invention, the recloseable lid can be opened so that a bag or other flexible container accommodated within the carton can be accessed. To close the carton, a portion of the bag can be inserted through the closure aperture section and the lid pivoted closed. When the lid is closed, the portion of the flexible container extends through the closure aperture section to the exterior of the carton. When closed, the closure aperture section of the recloseable lid secures the upper portion of the bag such that the bag contents remain securely retained within the bag. The lid provides easy access to the carton contents, and may be easily opened and reclosed.

According to a second aspect of the invention, the carton can be constructed to have an upper section or top panel that is larger than a lower section of bottom panel of the carton. The front, back, and side panels can taper outwardly from the bottom panel to the top panel. The relatively large upper section of the carton provides ease of access to the carton contents when the carton is opened.

Other aspects, features, and details of the present invention can be more completely understood by reference to the following detailed description, taken in conjunction with the drawings and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

Figure 1:
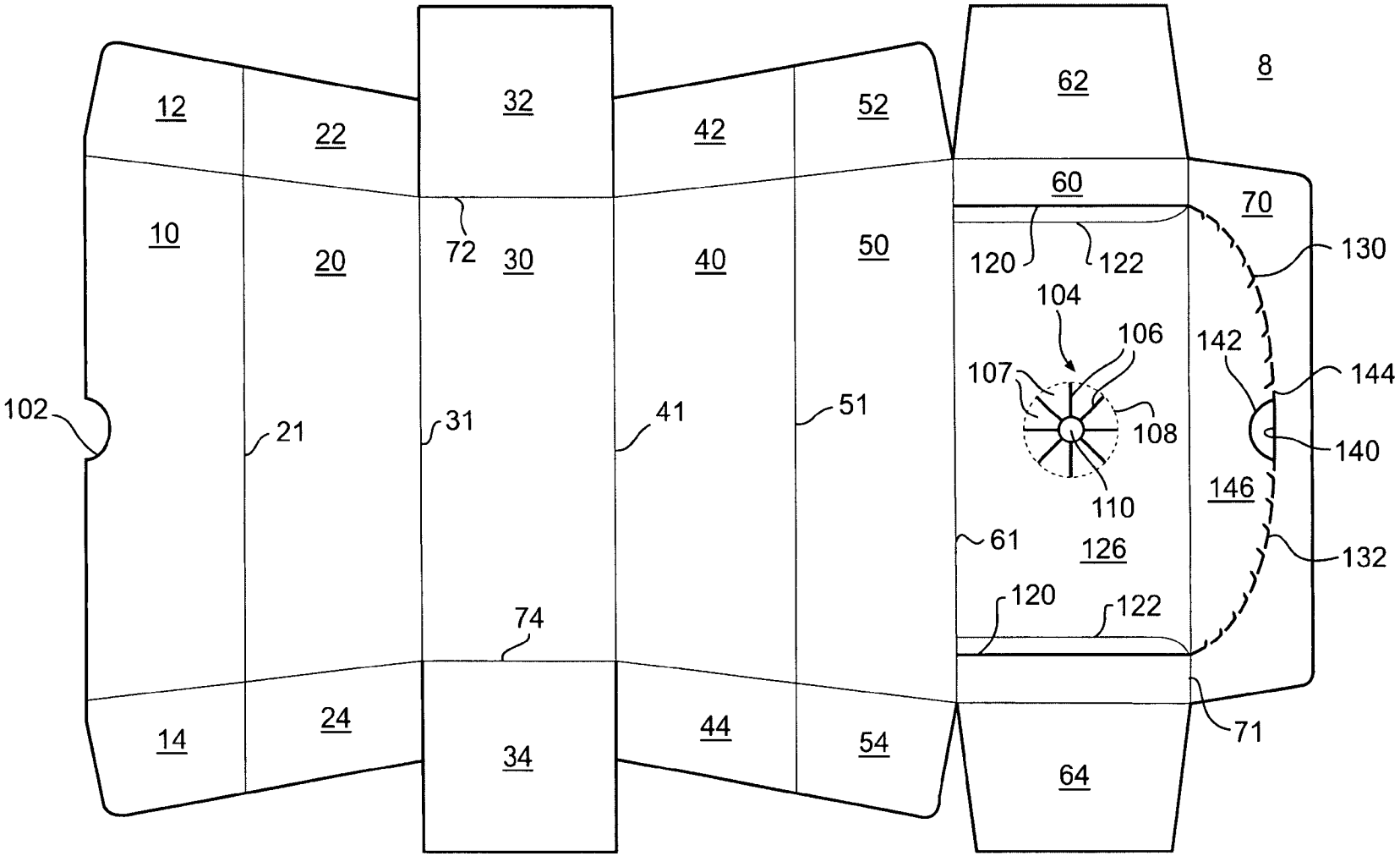
FIG. 1 is a plan view of a blank used to form a carton having a recloseable lid according to a first embodiment of the invention.

FIG. 1 is a plan view of a first, interior side of a blank 8 used to form a carton 150 (illustrated in FIG. 2) having a recloseable lid 155 according to a first embodiment of the invention. The blank 8 comprises a top front panel 10 foldably connected to a bottom front panel 20 at a first transverse fold line

21, a bottom panel 30 foldably connected to the bottom front panel 20 at a second transverse fold line 31, a bottom back panel 40 foldably connected to the bottom panel 30 at a third transverse fold line 41, a top back panel 50 foldably connected to the bottom back panel 40 at a fourth transverse fold line 51, and a top panel 60 foldably connected to the top back panel 50 at a fifth transverse fold line 61. A closure flap 70 is foldably connected to the top panel 60 at a sixth transverse fold line 71.

The top front panel 10 is foldably connected to first and second top front flaps 12, 14. The bottom front panel 20 is foldably connected to first and second bottom front flaps 22, 24. The bottom panel 30 is foldably connected to first and second bottom flaps 32, 34. The bottom back panel 40 is foldably connected to first and second bottom back flaps 42, 44. The top back panel 50 is foldably connected to first and second top back flaps 52, 54. The top panel 60 is foldably connected to first and second top flaps 62, 64.

The flaps 12, 22, 32, 42, 52, 62 generally extend along a first or top marginal area of the blank 8, and may be foldably connected along a first fold line 72 having a combination of longitudinal and oblique segments. The flaps 14, 24, 34, 44, 54, 64 extend along a second or bottom marginal area of the blank 8, and may be foldably connected along a second fold line 74 also having both longitudinal and oblique segments. The fold line 72 extends obliquely along the panels 10, 20 and the panels 40, 50, and tapers inwardly towards the bottom panel 30 where the fold line 72 extends in a longitudinal direction. The fold line 74 also extends obliquely along the panels 10, 20 and the panels 40, 50 and tapers inwardly towards the bottom panel 30 where the fold line 74 extends in a longitudinal direction. When the carton 150 is erected, the flaps 12, 22, 32, 42, 52, 62 close a first side of the carton 150, and the flaps 14, 24, 34, 44, 54, 64 close a second side of the carton 150.

Figure 2:
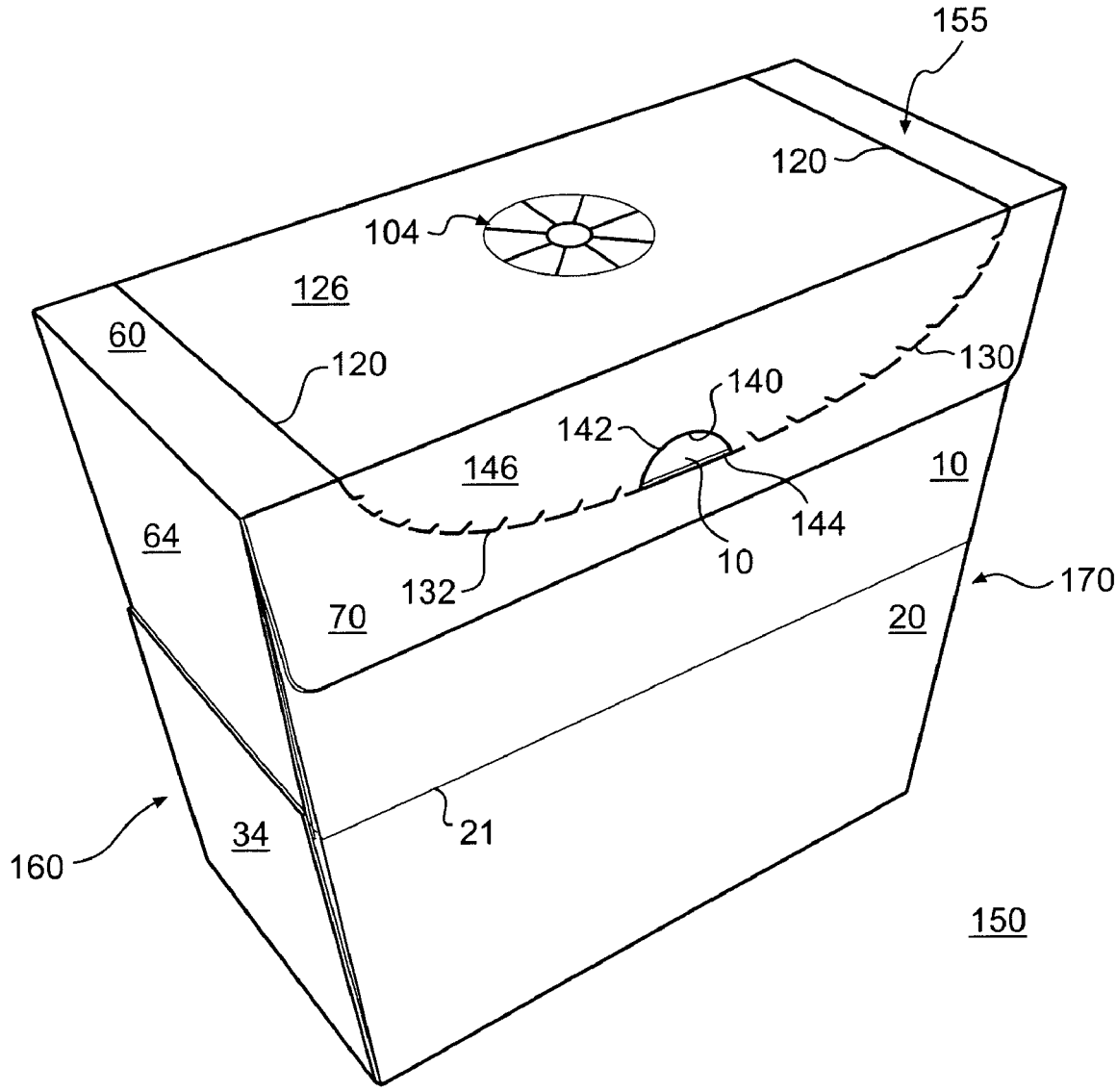
FIG. 2 is a perspective view of the carton according to the first embodiment of the invention.

According to a first aspect of the invention, portions of the top panel 60 and the closure flap 70 form the recloseable lid 155 in the carton 150 (FIG. 2). The top panel 60 includes a breachable closure aperture section 104 that serves to close an open end of a bag or other flexible container held within the carton 150. The perimeter of the closure aperture section 104 is defined by a circular line of disruption 108. Radially extending cuts or scores 106 extend outwardly from a removable center section 110 of the closure aperture section 104. A pivotable lid panel 126 is defined in the top panel 60 by pairs of generally longitudinally extending lines of disruption 120, 122. The pivotable lid panel 126 is foldably connected to a lid closure flap 146. The lid closure flap 146 is defined in the closure flap 70 by a pair of curved tear lines 130, 132 and cut lines 142, 144. The cut lines 142, 144 define an arcuate aperture 140 in the closure flap 70. The top front panel 10 includes an arcuate cutout section 102.

Figure 3:
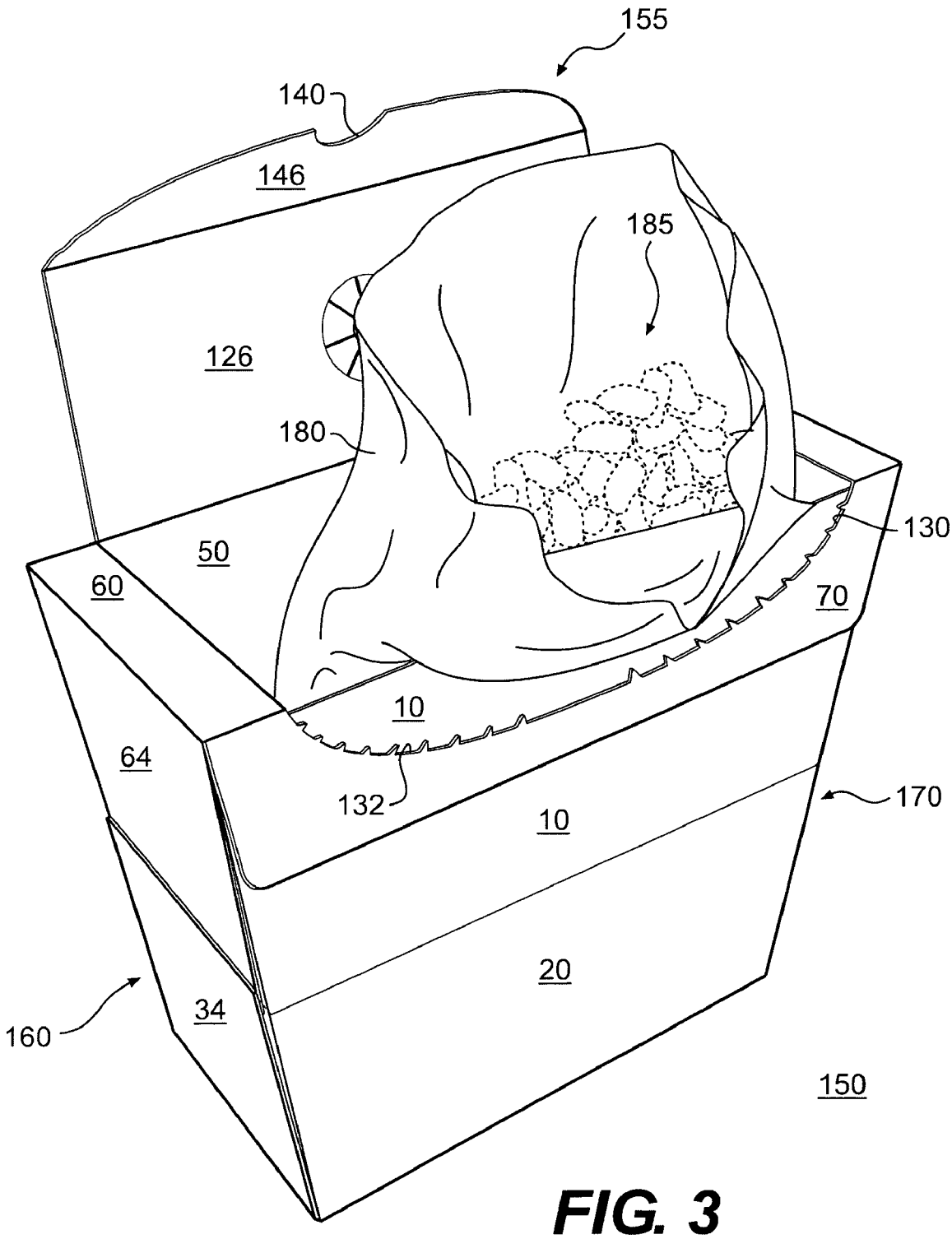
FIG. 3 illustrates opening of the recloseable lid.

In the present embodiment, the lines of disruption 106, 120 may be, for example, formed from continuous cuts, cuts interspersed with one or more nicks, cut-space lines, or score lines that are capable of being breached or torn. The circular perimeter line 108 may be formed from, for example, crease lines, score lines, or cut-crease lines. The lines 122 may be, for example, cut lines, and allow the carton 150 to be more easily opened at the lid closure flap 146 (FIG. 3). The cut lines 122 may be, for example, 50% cuts on the interior or back side of the blank 8.

The carton 150 may be erected by applying glue or other adhesive to the exterior surfaces of the flaps 12, 22, 42, 52, and the flaps 14, 24, 44, 54, and/or to the interior surfaces of the flaps 32, 34, 62, 64. Glue or other adhesive is also applied to the interior surface of the closure flap 70 in areas not including the lid closure flap 146, and/or to the exterior surface of the top front panel 10 in areas that will not contact the lid closure flap 146 in the erected carton 150. The blank 8 is then folded flat about the fold lines 21, 51 so that the closure flap 70 is adhered to the top front panel 10 to create a generally closed, flat tubular structure. The flat tubular structure is then opened, and the flaps 12, 22, 42, 52, 62, 14, 24, 44, 54, 64 are folded inwardly and adhered together to close the sides of the tube.

A bag 180 (shown in FIG. 3) or other suitable flexible container filled with dispensable product may be inserted in the carton 150 through the open sides of the tubular structure in a conventional manner at any time before enclosing the carton 150.

FIG. 2 illustrates the erected carton 150. In the erected carton 150, the flaps 12, 22, 32, 42, 52, 62 form a first side panel 160, and the flaps 14, 24, 34, 44, 54, 64 form a second side panel 170. The recloseable lid 155 comprises the lid panel 126 and the lid closure flap 146 and is defined in the upper part of the carton 150 by the tear lines 130, 132 and the lines 120, 144. The tear lines 130, 132 and the line 142 define a bottom front edge of the lid 155, and the longitudinal lines 120 define top side edges of the lid 155. In the erected carton 150, a portion of the top front panel 10 can be seen through the aperture 140 in the closure flap 70.

Referring back to FIG. 1, the tapered shape of the front and back panels 10, 20, 40, 50 provides the carton 150 with a relatively wide (across the front of the carton) upper section and a relatively narrow lower section. When viewed from the front or back, the carton 150 generally has the profile of a trapezium (i.e., a quadrilateral with two parallel sides). The top panel 60 also has a greater depth (measured across the sides of the carton) than the bottom panel 30, which provides the carton 150 with greater depth at the carton top. When viewed from the sides, the carton 150 generally has the profile of a trapezium. The shape of the carton 150 can be generally characterized as an inverted truncated four-sided pyramid.

FIG. 3 illustrates opening of the recloseable lid 155. Referring to FIGS. 2 and 3, the lid 155 may be opened by inserting a finger into the aperture 140 and pulling up on the lid closure flap 146. The lid closure flap 146, unlike the remainder of the closure flap 70, is not adhesively connected to the top front panel 10. The lid closure flap 146 may therefore separated from the remaining lower portion of the closure flap 70 by tearing along the tear lines 132, 134. The lid panel 126 can likewise be separated from the remainder of the top panel 60 along the lines 120. At this time, the top of the flexible container 180 in the carton 150 can be opened to expose the contents 185, as shown in FIG. 3. The bag contents 185 can be dispensed or otherwise consumed at this time as desired.

Figure 4:
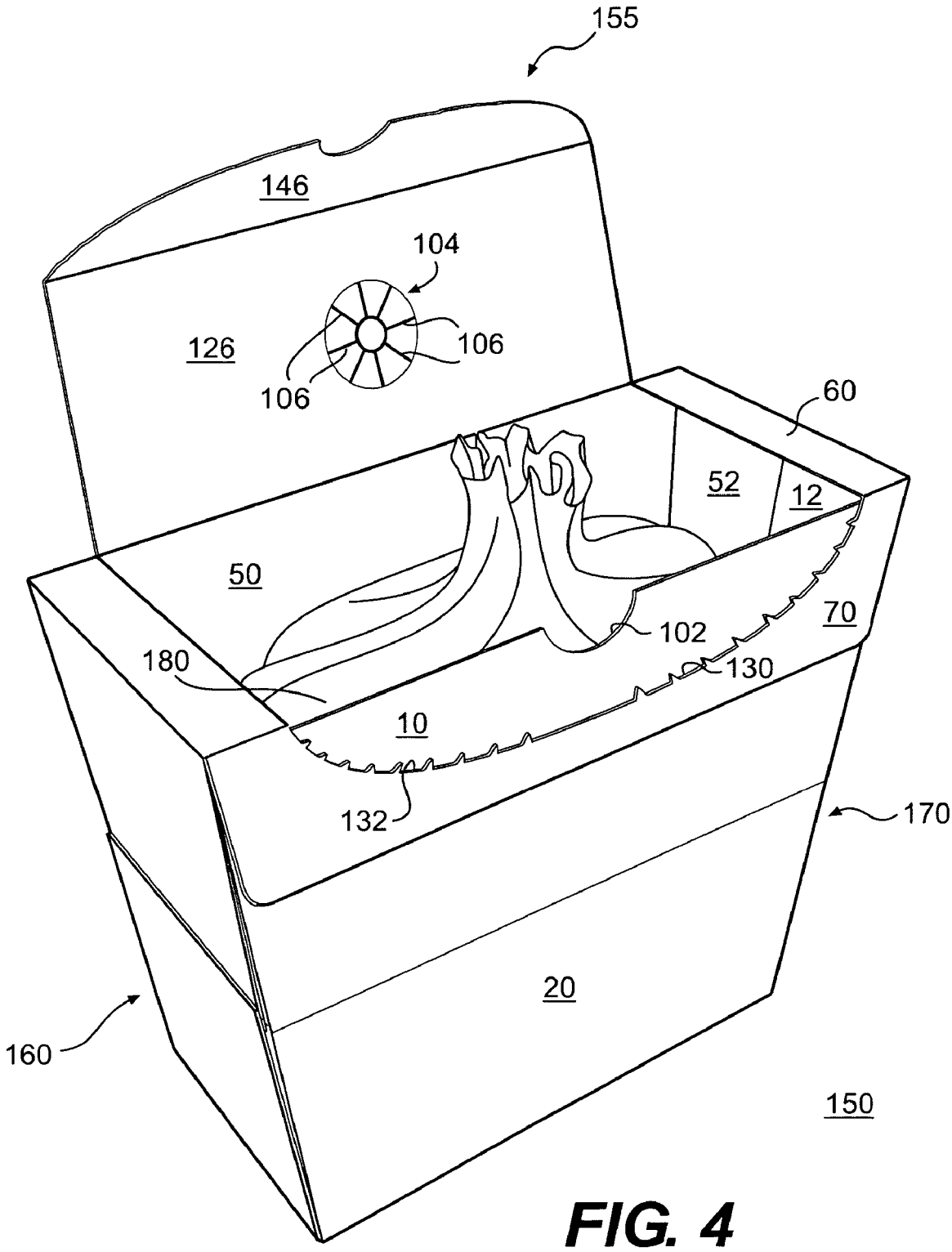
FIGS. 4 and 5 illustrate closing of the recloseable lid.
Figure 5:
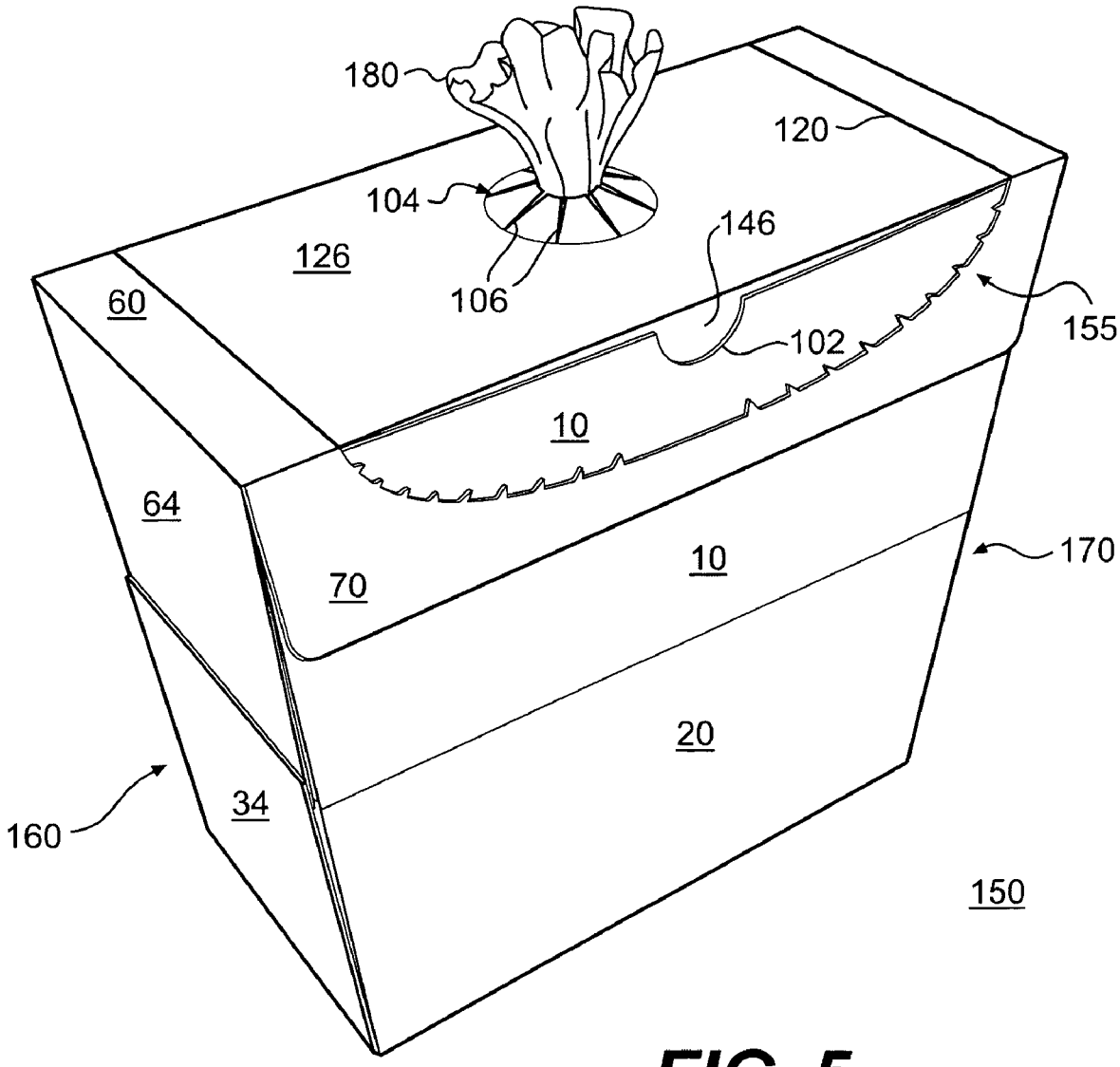

FIGS. 4 and 5 illustrate closing of the recloseable lid 155. To close the lid 155, the opened top portion of the bag 180 is gathered into a relatively tight bunch, as shown in FIG. 4. The center portion 110 of the closure aperture section 104 is punched out, and the bunched portion of the bag 180 is pushed through the opened center of the aperture section 104, causing the aperture section 104 to spread open at the radially extending lines 106. The lid 155 is then pivoted closed as shown in FIG. 5. In the closed position, the lid closure flap 146 of the lid 155 can be tucked in behind the top front panel 10. After the lid 155 is pivoted closed, more of the bunched top portion of the bag 180 can be pulled upwardly through the aperture section 104 to more securely close the bag 180. The aperture section 104 may secure the top of the bag 180 sufficiently tightly so that the bag contents remain securely retained within the bag.

To reopen the lid 155, the lid may be accessed at the cutout 102 and pivoted open. The bag 180 may be pulled back through the aperture section 104 as the lid 155 is pivoted open, or the bag 180 can be manually pulled back through the aperture 140 after the lid 155 is open. The bag contents 185 can again be dispensed from the bag 180 and afterwards the lid 155 can be reclosed for storage.

According to the above-described embodiments, the lid 155 provides easy access to the carton contents, and may be easily opened and reclosed. When closed, the lid 155 can secure the upper portion of a bag such that the bag contents remain securely retained in the bag.

Also according to the above-described embodiments, the carton 150 can be constructed to have an upper section or top panel that is larger than a lower section of bottom panel of the carton 150. The front, back, and side panels can taper outwardly from the bottom panel 30 to the top panel 60. The relatively large upper section of the carton 150 provides ease of access to the carton contents when the carton is opened.

The carton embodiment discussed above includes a bag suitable for housing foodstuffs and other products. Cartons according to the present invention may be, however, constructed without bags.

In the exemplary embodiments discussed above, the blank may be formed from, for example, clay coated newsprint (CCN), solid unbleached sulfate board (SUS), and other materials. In general, the blank may be constructed from board having a caliper of at least about 14, for example, so that it is heavier and more rigid than ordinary paper. The can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blank may then be coated with a varnish to protect information printed on the blank. The blank may also be coated with, for example, a moisture barrier layer, on either or both sides of the blanks. The blank can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features.

A tear line can be any substantially linear, although not necessarily straight, form of weakening that facilitates tearing therealong. Specifically, but not for the purpose of narrowing the scope of the present invention, tear lines include: a cut that extends partially into the material along the desired line of weakness, and/or a series of cuts that extend partially into and/or completely through the material along the desired line of weakness, or various combinations of these features. As a more specific example, one type of tear line is in the form of a series of cuts that extend completely through the material, with adjacent cuts being spaced apart slightly so that small somewhat bridge-like pieces of the material (e.g., 'nicks') are defined between adjacent cuts. The nicks are broken during tearing along the tear line. Such a tear line that includes nicks can also be referred to as a cut line, since the nicks typically are a relatively small in relation to the cuts.

The term "line" as used herein includes not only straight lines, but also other types of lines such as curved, curvilinear or angularly displaced lines.

In situations where cutting is used to create a fold line, typically the cutting will not be overly extensive in a manner that might cause a reasonable user to incorrectly consider the fold line to be a tear line. In contrast, where nicks are present in a cut line (e.g., tear line), typically the nicks will not be overly large or overly numerous in a manner that might cause a reasonable user to incorrectly consider the subject cut line to be a fold line.

The above embodiments may be described as having one or panels adhered together by glue. The term "glue" is intended to encompass all manner of adhesives commonly used to secure paperboard carton panels in place.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton, comprising:

at least one front panel;

at least one back panel;

at least one first side panel;

at least one second side panel;

a top panel;

a bottom panel, the at least one front panel, the at least one back panel, the at least one first side panel, the at least one second side panel, the top panel and the bottom panel defining an interior of the carton;

the interior of the carton being configured to contain a flexible container;

a closure flap;

a reclosable lid defined in the top panel and in the closure flap, the recloseable lid including a lid panel with a closure aperture section formed therein, the recloseable lid being pivotable between an open position and a closed position;

the closure aperture section having a narrow center opening that closes an open end of the flexible container when the flexible container is inserted through the narrow center opening.

2. The carton of claim 1, wherein the closure aperture section is selectively breachable to form an aperture at the narrow center opening for receiving a portion of the flexible container.

3. The carton of claim 2, wherein the closure aperture section comprises a plurality of radially extending lines of disruption.

4. The carton of claim 2, wherein the narrow center opening comprises a removable center section.

5. The carton of claim 1, wherein the recloseable lid further comprises a lid closure flap defined in the closure flap.

6. The carton of claim 5, wherein the lid closure flap is defined in the closure flap in part by at least one tear line extending across the front panel.

7. The carton of claim 6, wherein the closure flap is adhered to the at least one front panel at least one location, and the lid closure flap is not secured to the at least one front panel.

8. The carton of claim 6, wherein the lid panel is defined in the top panel by two lines of disruption extending from a front of the top panel toward a rear of the top panel.

9. The carton of claim 1, wherein the carton is wider at the top panel than at the bottom panel.

10. The carton of claim 9, wherein:

the at least one first side panel comprises a first plurality of adhesively secured flaps; and the at least one second side panel comprises a second plurality of adhesively secured flaps.

11. The carton of claim 9, wherein the at least one front panel comprises a bottom front panel and a top front panel.

12. The carton of claim 11, wherein the bottom front panel and the top front panel each have the shape of a trapezium.

13. The carton of claim 1, wherein the carton has the shape of a four-sided truncated pyramid.

14. The carton of claim 1, in combination with the flexible container disposed within the carton.

15. A carton blank having a longitudinal and a transverse axis, comprising:

at least one front panel;

a bottom panel connected to the front panel along a generally transverse fold line;

at least one back panel connected to the bottom panel along a generally transverse fold line;

a plurality of first flaps extending along a first marginal area of the blank and connected thereto along generally longitudinal fold lines;

at plurality of second flaps along a second marginal area of the blank and connected thereto along generally longitudinal fold lines;

a top panel connected to the back panel along a generally transverse fold line;

a closure flap foldably connected to the top panel along a generally transverse fold line, and a recloseable lid defined in the top panel and in the closure flap, the recloseable lid including a lid panel with a closure aperture section formed therein, the closure aperture section having a narrow center opening for closing an open end of a flexible container.

16. The carton blank of claim 15, wherein the closure aperture section is breachable to form an aperture at the narrow center opening for receiving a portion of a flexible container.

17. The carton blank of claim 16, wherein the closure aperture section comprises a plurality of radially extending lines of disruption.

18. The carton blank of claim 16, wherein the narrow center opening comprises a removable center section.

19. The carton blank of claim 15, wherein the recloseable lid further comprises a lid closure flap defined in the closure flap.

20. The carton blank of claim 19, wherein the lid closure flap is defined in the closure flap in part by at least one tear line extending across the closure flap.

21. The carton blank of claim 19, wherein the lid panel is defined in the top panel by two lines of disruption extending at least substantially longitudinally through the blank.

22. The carton blank of claim 15, wherein the at least one front panel comprises a bottom front panel and a top front panel.

23. The carton blank of claim 22, wherein the bottom front panel and the top front panel each have the shape of a trapezium.

24. A method of operating a carton, comprising:

providing a carton comprising: at least one front panel; at least one back panel; at least one first side panel; at least one second side panel; a top panel; a bottom panel, the at least one front panel, the at least one back panel, the at least one first side panel, the at least one second side panel, the top panel and the bottom panel defining an interior of the carton; the interior of the carton being configured to contain a flexible container; a closure flap, a recloseable lid is defined in the top panel and in the closure flap, the recloseable lid having a closure aperture section formed therein;

the recloseable lid being pivotable between an open position and a closed position;

the closure aperture section having a narrow center opening that closes an open end of the flexible container when the flexible container is inserted through the narrow center opening providing a flexible container within the carton;

opening the recloseable lid;

inserting a portion of the flexible container through the closure aperture section;

closing the recloseable lid, wherein the portion of the flexible container projects to an exterior side of the carton through the closure aperture section.

25. The method of claim 24, wherein inserting the portion of the flexible container through the closure aperture section comprises breaching the closure aperture section.

26. The method of claim 25, wherein breaching the closure aperture section comprises breaching a plurality of radially extending lines of disruption.

27. The method of claim 25, wherein breaching the closure aperture section comprises removing a removable center section of the closure aperture section.

28. The method of claim 25, wherein closing the recloseable lid comprises:

pivoting the recloseable lid toward the at least one front panel; and tucking a lid closure flap behind the at least one front panel.

29. The method of claim 24, wherein:

the at least one first side panel comprises a first plurality of adhesively secured flaps; and the at least one second side panel comprises a second plurality of adhesively secured flaps.

30. The method of claim 29, wherein the at least one front panel comprises a bottom front panel and a top front panel and the bottom front panel and the top front panel each have the shape of a trapezium.

31. A carton, comprising:

at least one front panel;

at least one back panel;

at least one first side panel;

at least one second side panel;

a bottom panel;

a top panel, wherein the carton is wider at the top panel than at the bottom panel;

a reclosable lid defined in the top panel and including a closure aperture section formed therein, the recloseable lid being pivotable between an open position and a closed position, the closure aperture section having a narrow center opening;

a flexible container within the carton, the flexible container having an open top and having contents that are readily dispensable from the flexible container;

at least a portion of the flexible container being extended through the narrow center portion to close the open end of the flexible container and retain the contents of the flexible container.

32. The carton of claim 31, wherein the carton has a greater depth, measured along the side panels, at the top panel than at the bottom panel.

33. The carton of claim 31, wherein the at least one front panel has the shape of a trapezium.

34. The carton of claim 31, wherein the at least one first side panel has the shape of a trapezium.

35. The carton of claim 31, wherein:

the at least one first side panel comprises a first plurality of adhesively secured flaps; and the at least one second side panel comprises a second plurality of adhesively secured flaps.

36. The carton of claim 31, wherein the carton has the shape of a four-sided truncated pyramid.

* * * * *

UNITED STATES PATENT AND TRADEMARK OFFICE

CERTIFICATE OF CORRECTION

PATENT NO. : 7,699,214 B2
APPLICATION NO. : 11/602646
DATED : April 20, 2010
INVENTOR(S) : Ignacio Mestre et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 535 days.

Signed and Sealed this
Twenty-ninth Day of March, 2011

David J. Kappos

David J. Kappos
*Director of the United States Patent and Trademark Office*